US011250740B2

(12) United States Patent
Aruga et al.

(10) Patent No.: US 11,250,740 B2
(45) Date of Patent: Feb. 15, 2022

(54) OPTICAL DEVICE AND ILLUMINATION DEVICE

(71) Applicant: NICHIA CORPORATION, Anan (JP)

(72) Inventors: Takanori Aruga, Suwa-gun (JP); Akira Nagahashi, Okaya (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/077,790

(22) Filed: Oct. 22, 2020

(65) Prior Publication Data

US 2021/0125529 A1 Apr. 29, 2021

(30) Foreign Application Priority Data

Oct. 29, 2019 (JP) ..... JP2019-195932

(51) Int. Cl.

| | |
|---|---|
| ***G09F 13/20*** | (2006.01) |
| ***F21V 7/00*** | (2006.01) |
| ***F21V 7/09*** | (2006.01) |
| ***F21V 7/04*** | (2006.01) |
| *F21W 131/40* | (2006.01) |
| *F21W 131/10* | (2006.01) |

(52) U.S. Cl.

CPC ..... *G09F 13/20* (2013.01); *F21V 7/0025* (2013.01); *F21V 7/0066* (2013.01); *F21V 7/041* (2013.01); *F21V 7/09* (2013.01); *F21W 2131/10* (2013.01); *F21W 2131/40* (2013.01)

(58) Field of Classification Search

CPC ..... G09F 13/20; F21V 7/0025; F21V 7/0066; F21V 7/041; F21V 7/09

See application file for complete search history.

(56) References Cited

U.S. PATENT DOCUMENTS

2012/0026735 A1* 2/2012 Ohta ..... F21V 7/28 362/235

2015/0241029 A1* 8/2015 York ..... G02B 19/0066 362/297

FOREIGN PATENT DOCUMENTS

JP 2003-195790 A 7/2003

* cited by examiner

*Primary Examiner* — Rajarshi Chakraborty
*Assistant Examiner* — Nathaniel J Lee
(74) *Attorney, Agent, or Firm* — Foley & Lardner LLP

(57) ABSTRACT

An optical device includes: a plurality of walls including at least a first wall and a second wall, wherein the plurality of walls are concentrically disposed around a first axis so as to be multi-stepped along the first axis, wherein each of the plurality of walls expands outward in a sector shape around the first axis at a predetermined central angle θ and includes an outer circumferential surface, a reflective curved surface at the outer circumferential surface, a first side end portion, and a second side end portion; a first reflective surface meeting the first side end portions of the walls; and a second reflective surface meeting the second side end portions of the walls. The first reflective surface and the second reflective surface meet each other on the first axis.

10 Claims, 6 Drawing Sheets

OPTICAL DEVICE AND ILLUMINATION DEVICE

CROSS-REFERENCE TO RELATED APPLICATION

This application claims priority to Japanese Patent Application No. 2019-195932, filed on Oct. 29, 2019, the entire contents of which are hereby incorporated by reference.

BACKGROUND

1. Field of the Invention

The present invention relates to an optical device and an illumination device employing the optical device.

2. Description of Related Art

Japanese Patent Publication No. 2003-195790 describes an illumination device that can uniformly illuminate display surfaces having a large area, such as large signboards, using a plurality of illuminators.

SUMMARY

One object of certain embodiments of the present invention is to provide an optical device with which a light distribution appropriate for a surface to be illuminated can be obtained within an illumination device so as to illuminate or project images on roads, signboards, wall surfaces, screens, or the like in an oblique direction, and to illuminate inclined surfaces, and the illumination device using the optical device.

An optical device according to one embodiment of the present invention includes a plurality of walls including at least a first wall and a second wall and concentrically disposed around a first axis to be multi-stepped along the first axis, each of the plurality of walls expanding outward in a sector shape around the first axis at a predetermined central angle θ and including an outer circumferential surface, a reflective curved surface at the outer circumferential surface, a first side end portion, and a second side end portion; a first reflective surface meeting the first side end portions of the walls; and a second reflective surface meeting the second side end portions of the walls. The first reflective surface and the second reflective surface meet on the first axis. Light incident along the first axis passes through an opening of the first wall at an incident side and is reflected at the outer circumferential surface of the second wall at an opposite side opposite to the incident side. The first reflective surface and the second reflective surface meet on the first axis at angles different between the incident side and the opposite side. The first wall has a first central angle that is different from a second central angle of the second wall.

An illumination device according to another embodiment of the present invention includes the above-described optical device and a light source to emit light along the first axis.

Certain embodiments of the present invention allows for providing an optical device with which a light distribution appropriate for a surface to be illuminated can be obtained within an illumination device so as to illuminate or project images on roads, signboards, wall surfaces, screens, or the like in an oblique direction, and to illuminate inclined surfaces, and the illumination device using the optical device.

DETAILED DESCRIPTION OF EMBODIMENTS

Figure 1:
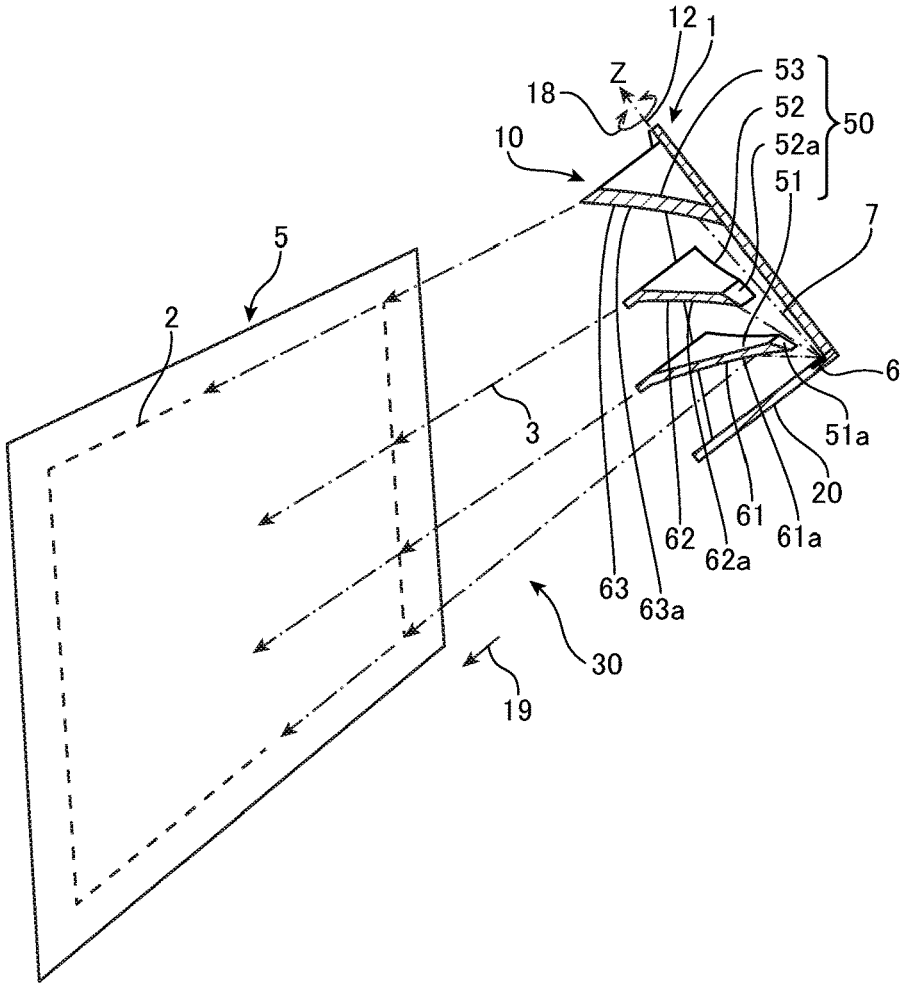
FIG. 1 schematically shows an example of illuminating a road and the like using an illumination device.

FIG. 1 schematically shows an example of an illumination device according to one embodiment of the present invention. An illumination device 1 casts or projects, in a frontward direction 19, light (illumination light) 30 that is controlled so as to illuminate a region 2 having a quadrangular shape or a linear shape on a surface 5 inclined with respect to the illumination device 1, such as a signboard or a road. The illumination device 1 may be obliquely disposed above or below the surface 5 of the signboard and the like to be illuminated, may be a streetlight supported by a post disposed at the surface 5 of the road to be illuminated, may be a headlight of a vehicle, or may be suitable for other applications in which a main optical axis 3 of the illumination light 30 is obliquely disposed with respect to the surface 5 to be illuminated.

Figure 2:
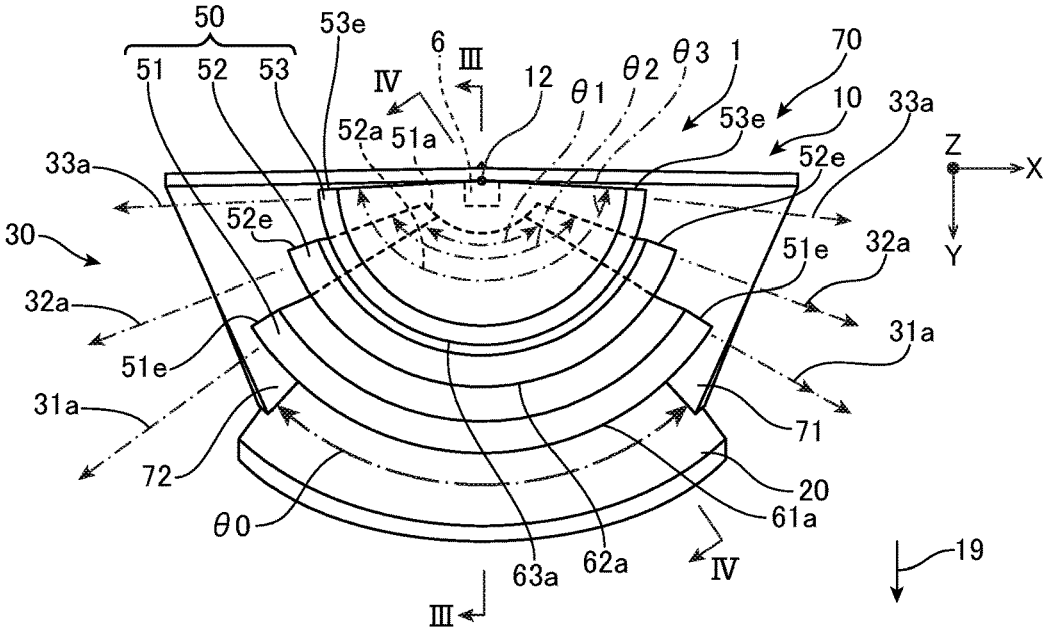
FIG. 2 is a schematic plan view of the illumination device.
Figure 3:
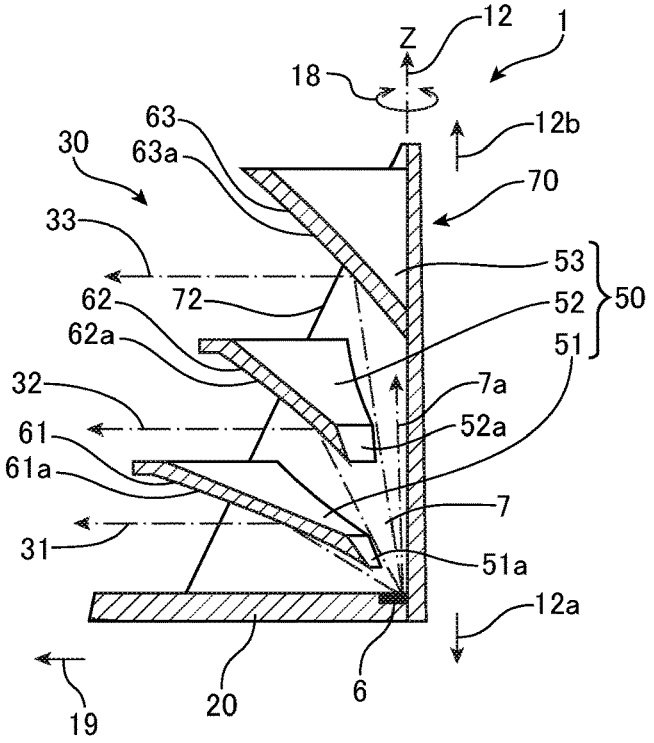
FIG. 3 is a schematic cross-sectional view of the illumination device taken along the line III-III of FIG. 2.
Figure 4:
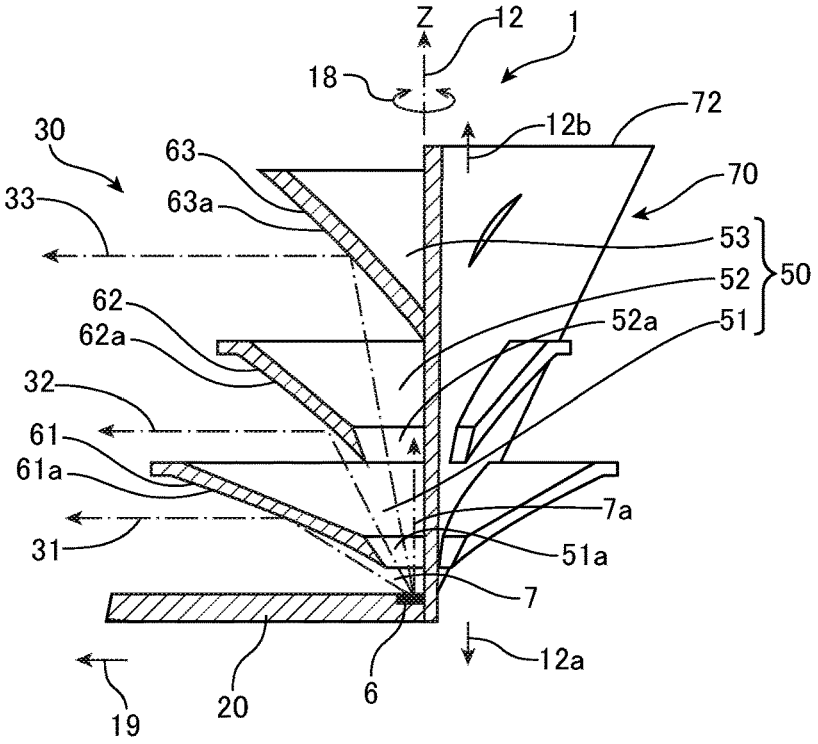
FIG. 4 is a schematic cross-sectional view of the illumination device taken along the line IV-IV of FIG. 2.

FIG. 2 is a schematic plan view of the illumination device 1. FIG. 3 is a schematic cross-sectional view of the illumination device 1 taken along the line of FIG. 2. FIG. 4 is a schematic cross-sectional view of the illumination device 1 taken along the line IV-IV of FIG. 2. The illumination device 1 includes an optical device 10 and a base (substrate) 20 including a light source (LED) 6 configured to emit light (source light) 7 along the first axis 12. The optical device 10 includes a plurality of sector-shape walls 50 concentrically disposed around an axis (a first axis or Z-axis) 12 in steps along the first axis 12. The plurality of walls 50 include a first wall 51, a second wall 52, and a third wall 53 that expands outward in a sector shape in a plane 18 perpendicular to the first axis 12 at predetermined central angles θ1, θ2, and θ3, respectively.

The walls 51 to 53 include reflective curved surfaces 61*a* to 63*a* on outer circumferential surfaces 61 to 63, respectively. A portion of the light 7 incident along the first axis 12 is reflected at the reflective curved surface 61*a* of the outer circumferential surface 61 of the wall 51 at an incident side 12*a*. Another portion of the incident light 7 passes an opening 51*a* of the first wall 51 at the incident side 12*a*, reaches the outer circumferential surface 62 of the second wall 52 at an opposite side 12*b*, which is a side opposite to the incident side 12*a*, and is reflected at the reflective curved surface 62*a*. A component of the incident light 7 advancing along the first axis 12 passes an opening 52*a* of the second wall 52, reaches the outer circumferential surface 63 of the third wall 53 at the opposite side 12*b*, and is reflected at the reflective curved surface 63*a*.

Each of the outer circumferential surfaces 61 to 63 of the walls 51 to 53 expands outward in a sector shape around the first axis 12 (in a X-Y plane 18 perpendicular to the first axis 12) in a plan view, which is tapering toward the incident side of each of the walls 51 to 53, in a shape of a funnel shape, a truncated cone shape, or the like such that each of the reflective curved surfaces 61*a* to 63*a* may have a funnel shape, a truncated cone shape, or the like Among the first to third walls 51 to 53, the first and second walls 51 and 52, that is, walls other than the third wall 53 located at the opposite side 12*b* opposite to the incident side 12*a* (for example, an uppermost wall or a lowermost wall), include the openings 51*a* and 52*a* centered on the first axis 12 and located at the incident side 12*a*. The third wall 53, which is located closest to the opposite side 12*b* opposite to the incident side 12*a* among the first to third walls 51 to 53, has the outer circumferential surface 63 without an opening at the incident side 12*a*.

Each of the reflective curved surfaces disposed on the walls 51 to 53 or the reflective curved surfaces 61*a* to 63*a* may have a mirror surface or a diffusing reflective curved surface. The incident side 12*a* may be hereinafter referred to as a "lower side" and the opposite side 12*b* opposite to the incident side 12*a* may be referred to as an "upper side." However, the incident side 12*a* may be at the upper side. Alternatively, the incident side 12*a* may be oriented in a lateral (right-left) direction or toward an oblique direction inclined at an appropriate angle.

Figure 5:
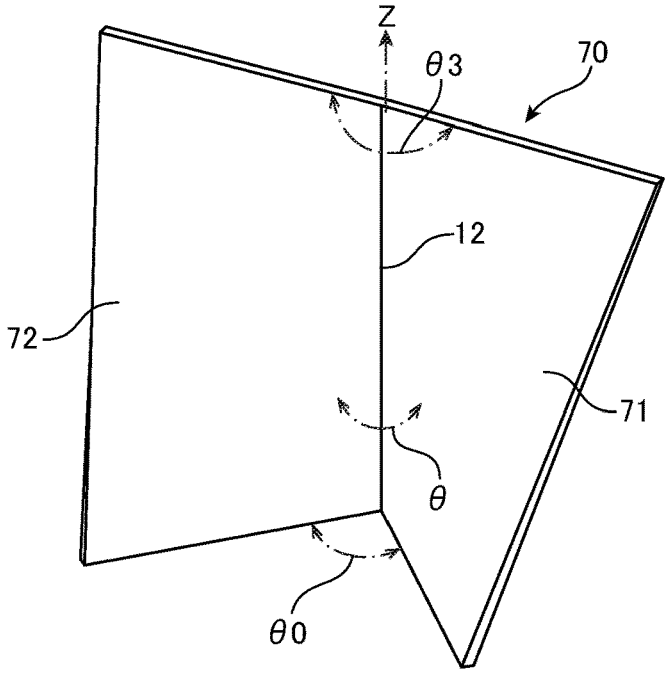
FIG. 5 is a schematic perspective view showing a wall surface that includes a first reflective surface and a second reflective surface.
Figure 6A:
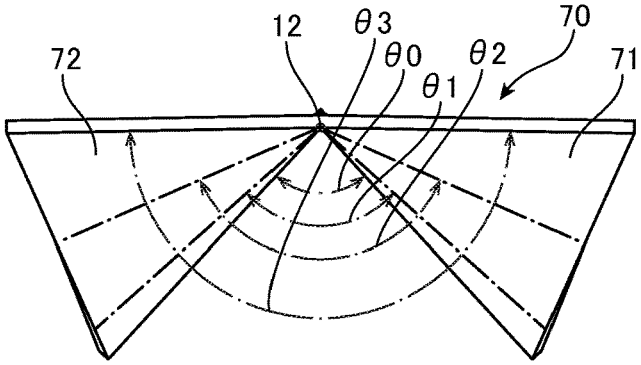
FIG. 6A is a schematic plan view of the wall surface.
Figure 6B:
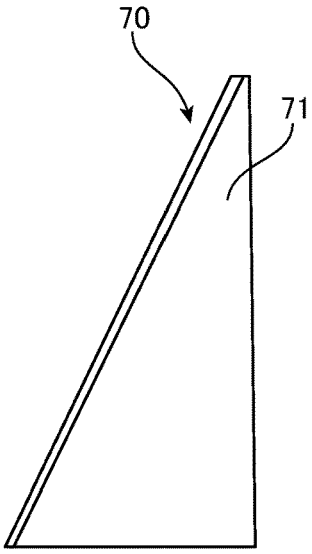
FIG. 6B is a schematic side view of the wall surface.

The optical device 10 further includes a wall surface (lateral wall) 70 that includes a first reflective surface 71 and a second reflective surface 72, each meeting side end portions 51*e* to 53*e* of the plurality of walls 50 (51 to 53). FIGS. 5 and 6 schematically illustrate the lateral wall 70 that includes the first reflective surface 71 and the second reflective surface 72. As shown in these drawings, the first reflective surface 71 and the second reflective surface 72 meet on the first axis 12.

The first reflective surface 71 and the second reflective surface 72 meet on the first axis 12 at an angle θ that is different between the incident side 12*a* and the opposite side 12*b*. Accordingly, the first to third walls 51 to 53 disposed between the first reflective surface 71 and the second reflective surface 72 have central angles θ1 to θ3, respectively, that are different from each other.

The first reflective surface 71 and the second reflective surface 72 typically meet at angles θ such that the θ3 at the opposite side 12*b*, opposite to the incident side 12*a*, is larger than an angle θ0 at the incident side 12*a*. Among the central angles θ1 to θ3 of the first to third walls 51 to 53 between the first reflective surface 71 and the second reflective surface 72, the central angle θ3 is the largest, the central angle θ2 is the second largest, and the central angle θ1 is the smallest.

The central angle (angle at which the first reflective surface 71 and the second reflective surface 72 meet) 0 may satisfy the following condition (1).

$$30 \text{ degrees} \leq \theta \leq 180 \text{ degrees} \quad (1)$$

In the optical device 10 of the present example, the angle θ0 at the incident side 12*a* is substantially 90 degrees and the angle θ3 at the opposite side 12*b* is substantially 180 degrees. The angles θ0 to θ3 may be any other appropriate values.

For the walls 51 to 53 and the lateral wall 70, a metal material may be used, or an organic or inorganic material with a reflective film on a surface thereof may be used. Examples of the reflective film include a film of a metal or a reflective material formed by vapor deposition, a layered structure in which a plurality of thin films having different refractive indices are layered to have a predetermined reflection characteristic, and a thin film with a structure to have another predetermined reflection characteristic. The reflective curved surfaces 61*a* to 63*a* and the reflective surfaces 71 and 72 may have respective reflectances selected according to applications of the illumination device 1, and may be a mirror reflective surface or a diffusing reflective surface.

In the optical device 10, the walls 51 to 53 and the wall surface 70 may have a thin plate-like structure to allow improvement in heat dissipation efficiency, which allows for reducing increase in temperature in the illumination device 10 and the illumination device 1. The walls 51 to 53 and the wall surface 70 may be made of material(s) having a thermal conductivity of approximately 10 W/m·k or more. Typical examples of materials for the walls 51 to 53 and the wall surface 70 include metals such as stainless steel and aluminum, resins or ceramics containing materials such as carbon, silicon, or carbon nanotubes with a high thermal conductivity as a filler.

The material for the walls 51 to 53 and the wall surface 70 may have a thermal conductivity of approximately 5 W/m·k or more, 50 W/m·k or more, or 100 W/m·k or more. When using a material with a very high thermal conductivity such as carbon nanotube for the walls 51 to 53, such a material may have a thermal conductivity of 2000 to 5000 W/m·k or the like. When using a metal or carbon material for the walls 51 to 53, the thermal conductivity of the metal or carbon materials may be in a range of 100 to 400 W/m·k. Examples of materials that has a high thermal conductivity and can be readily formed include a die-cast material having a thermal conductivity in a range of 100 to 150 W/m·k. The materials having the thermal conductivity as described above may be formed by plastic processing.

FIGS. 3 and 4 schematically show a state in which the light (which may be referred to as incident light or source light) 7 incident on multi-stepped walls 50 of the optical device 10 along the first axis (Z-axis) 12 is emitted in the direction 19 perpendicular to the Z-axis 12. The light 7 emitted from the LED (light source) 6 has a Lambertian light distribution around the optical axis 7*a*. A component of the light 7 around the optical axis 7*a* is reflected by a corresponding one of the reflective curved surfaces 61*a* to 63*a* disposed along the plane 18 perpendicular to the Z-axis 12 to emit illumination light 30 gradually spreading from the incident side 12*a* to the opposite side 12*b* in a fan shape with the central angle θ.

That is, a component of the incident light 7, emitted from the LED 6 serving as a light source, with a greatest light distribution angle with respect to the optical axis 7*a* is reflected at the first reflective curved surface 61*a* of the first wall 51 at the incident side 12*a* in the frontward direction 19 as first illumination light 31. A component of the light 7 on the first wall 51 at a first axis 12 side, that is, a component of the light 7 transmitted through the opening 51*a* at an optical axis 7*a* side and having a greater light distribution angle, is reflected at the second reflective curved surface 62*a* of the second wall 52 in the frontward direction 19 as second illumination light 32. A component of the light 7, transmitted through the opening 52*a* of the second wall 52 at the optical axis 7*a* side and advancing along the optical axis 7*a* of the light 7 is reflected at the third reflective curved surface 63*a* of the third wall 53 in the frontward direction 19 as third illumination light 33.

The central angles θ1 to θ3 of the reflective curved surfaces 61*a* to 63*a*, respectively, gradually increase from the incident side 12*a* to the opposite side 12*b* along a meeting angle θ of the first reflective surface 71 and the second reflective surface 72 between which the reflective curved surfaces 61*a* to 63*a* are located. Accordingly, the central angle θ of the illumination light 31 to 33 emitted from the reflective curved surfaces 61*a* to 63*a* of respective steps in the frontward direction 19 gradually increases from the incident side 12*a* to the opposite side 12*b*. For example, the central angle (divergence angle or illuminating angle) θ emitted from the reflective curved surfaces 61*a* to 63*a* of respective steps in the frontward direction 19 gradually increases as shown in FIG. 2. Accordingly, with the optical device 10, the illumination light 30 spreading in a truncated shape in the frontward direction 19 narrower at the incident side (for example, a lower side) 12*a* and wider at the opposite side (for example, an upper side) 12*b* opposite to the incident side 12*a*.

That is, the optical device 10 includes the multi-stepped sector-shape reflective curved surfaces 61*a* to 63*a* configured such that the light 7 incident along the first axis 12 is divided and reflected in the frontward direction 19, which is a direction perpendicular or inclined with respect to the first axis 12, in a predetermined range of the angle θ in the plane 18 perpendicular to the first axis 12. In the present example, the predetermined regions of respective sector-shape reflective curved surfaces are represented by angles θ1 to θ3. The optical device 10 includes a first reflective structure 50 that includes a plurality of walls 50 that are respectively reflective members, the plurality of walls 50 respectively having different central angles θ for the reflective curved surfaces 61*a* to 63*a* on respective outer circumferential surfaces. The optical device 10 includes a second reflective structure (the wall surface) 70 that includes the first reflective surface 71 and the second reflective surface 72 that meet at the first axis 12 and form an angle θ that differs at the incident side 12*a* and the opposite side 12*b* of the first axis 12. The walls 50 of the first reflective structure 50, having different central angles θ, are disposed between the first reflective surface 71 and the second reflective surface 72. Examples of the multi-stepped reflective curved surfaces 61*a* to 63*a* include reflective surfaces, each expanding outward in a sector shape along the first axis (Z-axis) 12 and inclined at an acute angle with respect to a plane (the X-Y plane) perpendicular to the first axis 12.

The optical device 10 is configured such that the light 7 is reflected at the reflective curved surfaces 61*a* to 63*a* and the reflective surfaces 71 and 72 in the direction 19 perpendicular to the optical axis 7*a* in a sector shape to convert the light 7 with the Lambertian light distribution into the illumination light 30 with a light distribution appropriate for illuminating a region having a quadrangular shape or a linear shape. Further, with the multi-stepped reflective curved surfaces 61*a* to 63*a*, the light 7 is reflected toward the direction 19 perpendicular to the optical axis 7*a* to be converted into the illumination light 30 in the direction perpendicular to the optical axis 7*a*, and spreading (the central angle) of the illumination light 30 is controlled along the optical axis 7*a*. Accordingly, portions of the light 7 at the same luminous intensity in the Lambertian light distribution, in which a luminous intensity varies according to the distribution angle, can be spread around the optical axis 7*a* with an appropriate central angle θ in the direction perpendicular to the optical axis 7*a*. This allows the illumination light 30 to spread in an appropriate shape such as a trapezoidal shape.

Further, in the optical device 10, the light (luminous flux) having the highest luminous intensity on the optical axis 7*a* is spread into an appropriate area, and curvature or inclination of the multi-stepped reflective curved surfaces are controlled to control the luminous intensity in a width direction of the illumination light 30 having an appropriate shape. This configuration allows the illumination light 30 to spread in an appropriate shape such as a trapezoidal shape and to have an appropriate controlled luminous intensity distribution. In one typical example, the illumination light 30 obtained from the optical device 10 spreads into a trapezoidal shape wider at the opposite side 12*b*, opposite to the incident side 12*a*, than the incident side 12*a* and having a larger intensity (luminance or luminous intensity) at the incident side 12*a* (the short side of the trapezoidal shape), than at the opposite side 12*b* (the long side of the trapezoidal shape). The illumination light 30 having the trapezoidal-shape intensity distribution can illuminate the quadrangular region 2 of the surface 5 that is obliquely inclined with respect to the optical axis 3 of the illumination light 30 such that the short side is located farther from the optical axis 3 than the long side at substantially uniform intensity.

While the optical device 10 of the present example includes three-steps of reflective curved surfaces 61*a* to 63*a*, other number of reflective curved surfaces may be employed, and two or less or four or more steps of reflective curved surfaces may be employed. While a single step of a reflective curved surface may be employed, employing a multi-stepped structure in which the wall 51 that constitutes the reflective curved surface 61*a* and has the opening 51*a* at the first axis 12 and the wall 52 that constitutes the reflective curved surface 62*a* and has the opening 52*a* at the first axis 12 are disposed, and in which a component of the light 7 along the optical axis 7*a* is transmitted through the openings 51*a* and 52*a* and reflected at the reflective curved surfaces 62*a* and 63*a* disposed above the openings 51*a* and 52*a*, respectively, allows for reducing increase of radius of each of the reflective curved surfaces 61*a* to 63*a*, so that a compact optical device 10 can be obtained.

Figure 7:
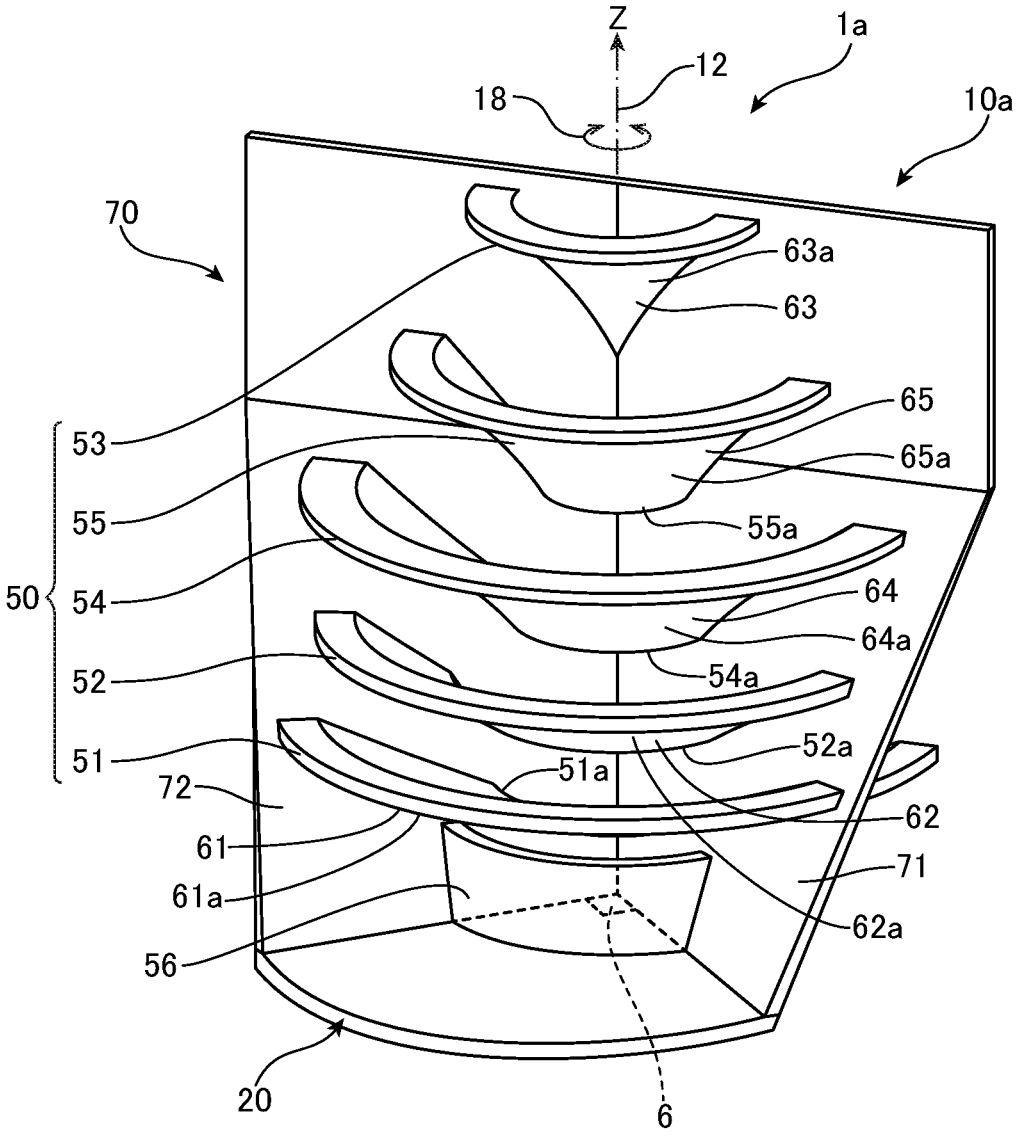
FIG. 7 is a schematic perspective view of another example of an illumination device.

FIG. 7 is a schematic perspective view of another example of the illumination device according to one embodiment of the present invention. An illumination device 1*a* includes an optical device 10*a* including a plurality of sector-shaped walls 50 disposed in steps along the first axis 12, and a base (substrate) 20 including a light source (LED) 6 configured to emit light (source light) 7 along the first axis 12. The optical device 10*a* includes the walls 51 to 53 and two additional walls 54 and 55 concentrically disposed about the first axis (which may also referred to as Z-axis) 12 between the uppermost wall 53 and lowermost walls 51 and 52, that is, in total, the plurality of walls 51 to 55 disposed in five steps along the first axis 12. The optical device 10*a* further includes a cylindrical lens 56 disposed at the incident side 12*a* of the lowermost wall 51 and the wall surface 70 including the first reflective surface 71 and the second reflective surface 72 that meet on the first axis 12.

Figure 8:
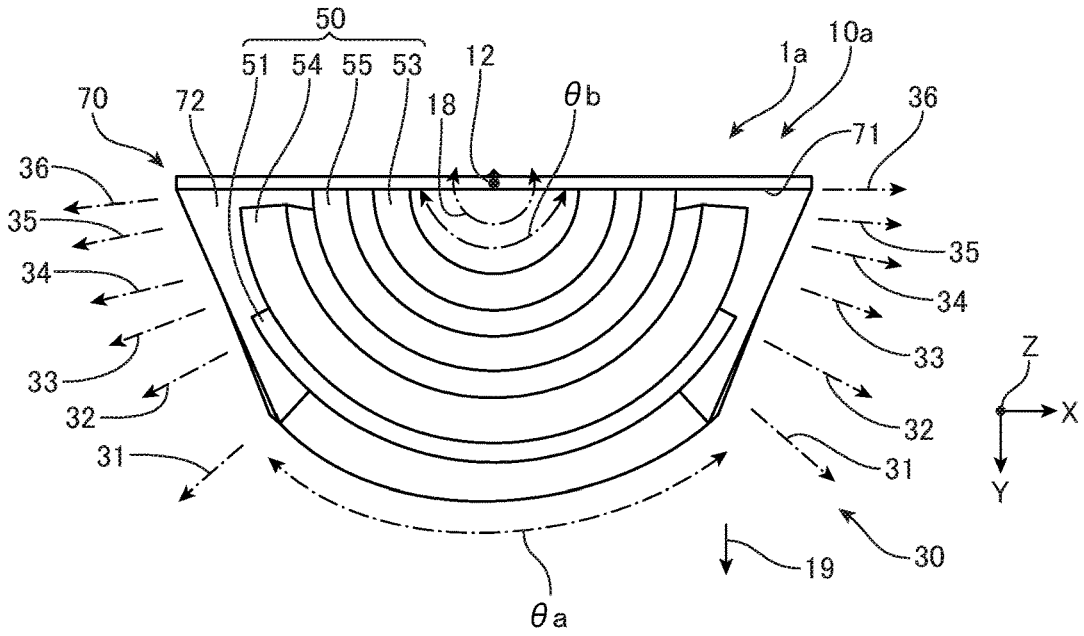
FIG. 8 is a schematic plan view of the another example of the illumination device.
Figure 9:
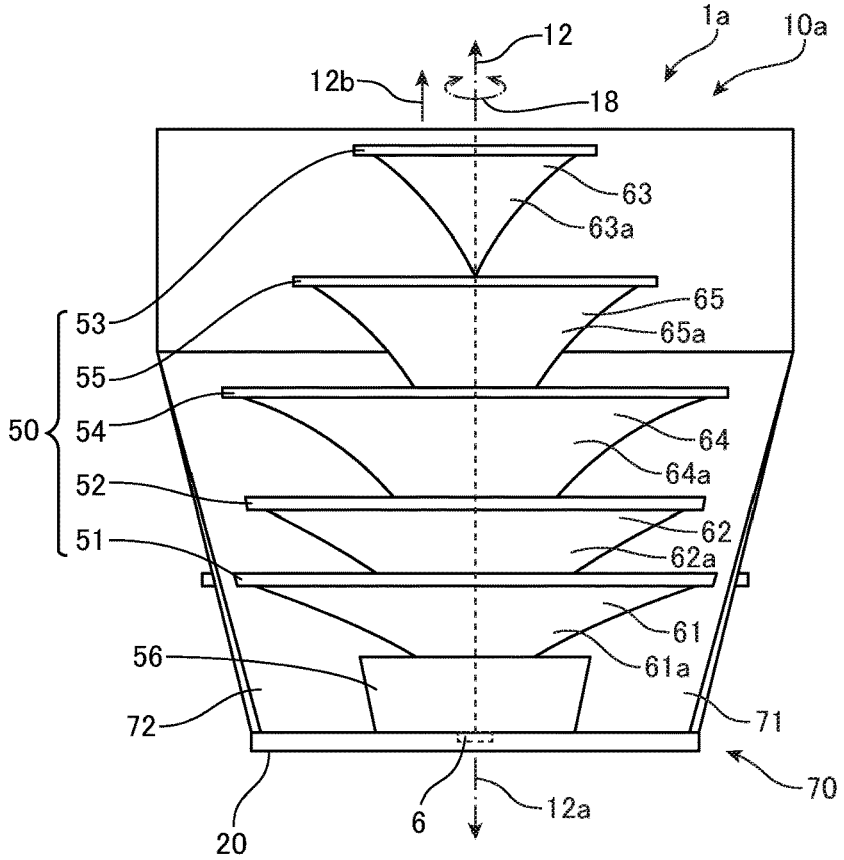
FIG. 9 is a schematic front view of the another example of the illumination device.
Figure 10:
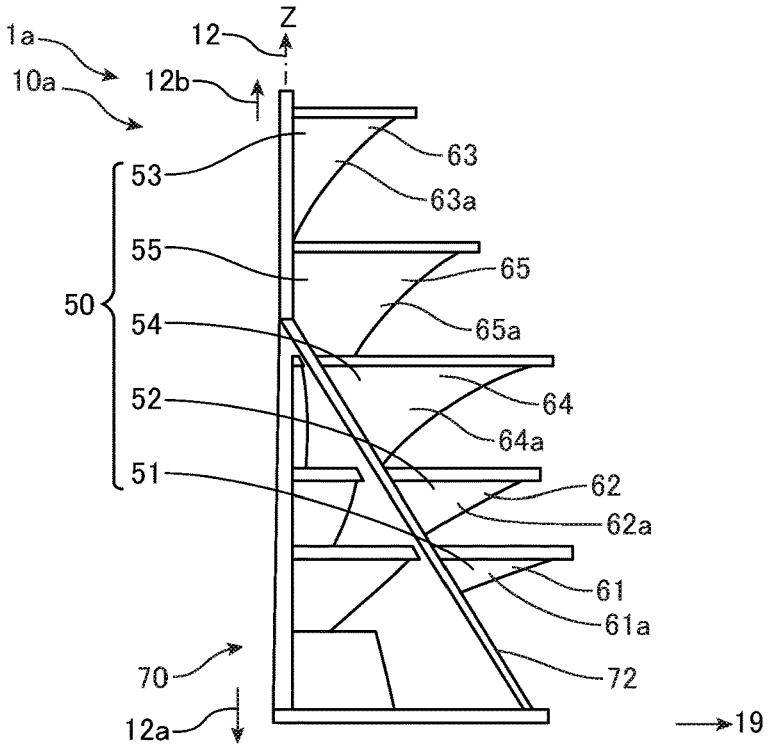
FIG. 10 is a schematic side view of the another example of the illumination device.
Figure 11:
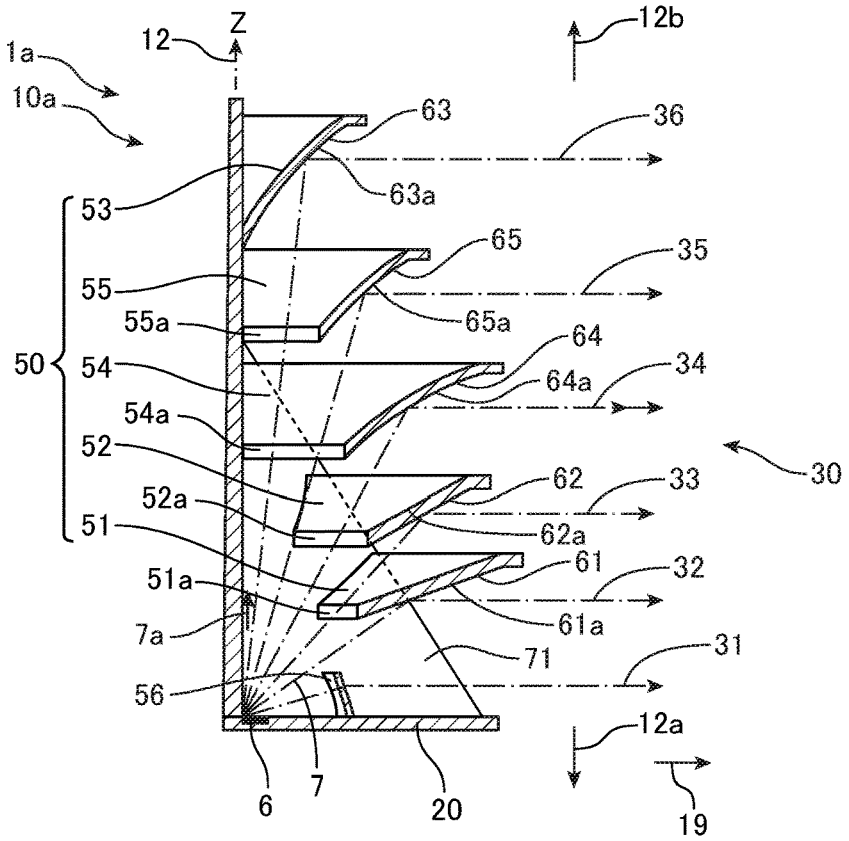
FIG. 11 is a schematic cross-sectional view of the another example of the illumination device.

FIG. 8 is a schematic view of the illumination device 1*a* when viewed from above the illumination device (a schematic plan view). FIG. 9 is a schematic view of the illumination device 1*a* when viewed from a front side of the illumination device (a schematic front view). FIG. 10 is a schematic side view of the illumination device 1*a*. FIG. 11 is a schematic cross-sectional view of the illumination device 1*a*. The optical device 10*a* includes the walls 51 to 53 same as the walls 51 to 53 of the optical device 10, and the walls 54 and 55 between the walls 52 and 53. The walls 54 and 55 have shapes similar to those of the walls 51 and 52 of the lower steps. That is, each of the outer circumferential surfaces 64 and 65 of the walls 54 and 55 expands outward in a sector shapearound the first axis 12 (in a X-Y plane 18 perpendicular to the first axis 12) in a plan view, which is tapering toward the incident side of each of the walls 54 and 55, in a shape of a funnel shape, a truncated cone shape, or the like such that each of the reflective curved surfaces 64*a* to 65*a* may have a funnel shape, a truncated cone shape, or the like. The walls 54 and 55 include, at the incident side 12*a*, openings 54*a* and 55*a* centered on the first axis 12.

The walls 51 to 55 are disposed between the first reflective surface 71 and the second reflective surface 72. The first reflective surface 71 and the second reflective surface 72 meet on the first axis 12 at an angle θ that is different between an angle θa at the incident side 12*a* and an angle θb at the opposite side 12*b* opposite to the incident side 12*a*. In the present example, the angle θb at the opposite side 12*b* is larger than the angle θa at the incident side 12*a*. For example, the angle θa at the incident side 12*a* is 90 degrees and the angle θb at the opposite side 12*b* opposite to the incident side 12*a* is 180 degrees.

In the optical device 10*a*, a component of the light 7 emitted from the LED 6 and incident along the first axis 12 at the largest angle of the light distribution is emitted as the illumination light 31 in the direction (the front) 19 perpendicular to the optical axis 7*a* through the lens 56 of a lowermost step. A component of the incident light 7 having the second largest distribution angle is emitted via the reflective curved surface 61*a* of the outer circumferential surface 61 of the lowermost wall 5 in the frontward direction 19 as illumination light 32. A portion of the component of the incident light 7 passing through the opening 51*a* of the funnel-shaped wall 51 constituting the reflective curved surface 61*a* of the lowermost step is emitted via the reflective curved surface 62*a* at an upper step in the frontward direction 19 as illumination light 33. Similarly, a portion of the component of the incident light 7 passing through the opening 52*a* of the funnel-shaped wall 52 constituting the reflective curved surface 62*a* at the lower side is emitted via the reflective curved surface 64*a* of an upper step in the frontward direction 19 as illumination light 34. A portion of the component passing through the opening 54*a* of the wall 54 is emitted via the reflective curved surface 65*a* of an upper step in the frontward direction 19 as illumination light 35. A portion of the component passing through the opening 55*a* of the funnel-shaped wall 55 constituting the reflective curved surface 65*a* at a lower side is output via the reflective curved surface 63*a* of an uppermost step in the frontward direction 19 as illumination light 36.

The reflective curved surfaces 61*a* to 65*a* are located between the first reflective surface 71 and the second reflective surface 72. The central angle θb of the opposite side 12*b*, opposite to the incident side 12*a*, at an upper step is larger than the central angle θa of the incident side 12*a* at a lower step. Hence, the central angle (illuminating angle, divergence angle) of the illumination light 36 emitted from an upper step of the optical device 10*a* is larger than the illumination light 31 emitted from a lower step. In the illumination device 1*a* of the present example, the illumination light 30 having a trapezoidal-shaped distribution, which is larger at the opposite side (upper side) 12*b* than at the incident side (lower side) 12*a* along the first axis 12, is emitted in the frontward direction 19.

As described above, each of the illumination devices 1 and 1*a* includes the optical devices 10 and 10*a*, each of which includes the reflective surfaces 71 and 72 and the reflective curved surfaces 61*a* to 63*a* or the reflective curved surfaces 61*a* to 65*a*. The reflective surfaces 71 and 72 meet on the first axis 12 that is parallel to the axis 7*a* of the incident light 7, and have a meeting angle θ that varies along the first axis 12. The reflective curved surfaces 61*a* to 63*a* or the reflective curved surfaces 61*a* to 65*a* constitute multi-stepped reflective curved surfaces disposed in a region located between the reflective surfaces 71 and 72. Each of the reflective curved surfaces 61*a* to 63*a* or each of the reflective curved surfaces 61*a* to 65*a* has an sector-shape cross section in the first axis 12, that is, the optical axis 7*a*, and has the central angle θ that varies according to the meeting angle θ of the reflective surfaces 71 and 72. In each of the optical devices 10 and 10*a*, when the light 7 emitted from the LED 6 serving as a light source is emitted as the illumination light 30 toward the direction perpendicular to the optical axis, a radiation angle (divergence angle or central angle) 0 is controlled by controlling the meeting angle θ of the reflective surfaces 71 and 72. This configuration of the optical devices 10 and 10*a* can convert the light 7 from the LED 6 into the illumination light 30 having a shape such as trapezoidal shape, a barrel shape, a pincushion shape, or other shapes other than a rectangular shape.

Hence, the illumination devices 1 or 1*a* using the optical devices 10 or 10*a* can output the illumination light 30 with a distribution having a shape other than a rectangular shape. For example, the illumination device 1 or 1*a* can emit the illumination light 30 having a trapezoidal-shaped distribution. This allows for providing an illumination device that can efficiently, more uniformly, and brightly illuminate the quadrangular region 2 on the surface 5 that is inclined with respect to the optical axis 3 of the illumination light 30 or the optical axis 7*a* of the light 7 emitted from the LED 6.

The optical device is configured to convert light of the axisymmetric light distribution, such as the Lambertian light distribution, incident along the first axis into light of a light distribution in the direction perpendicular to the axis via the outer circumferential surfaces of the multi-stepped walls, each expanding outward in a sector shape along the first axis, and emit the converted light. In the optical device, the meeting angles of the first reflective surface and the second reflective surface on the first axis are different between the incident side and the opposite side, which controls the light distribution (divergence angle or illuminating angle) along the first axis. Accordingly, with the illumination device using the optical device having such configuration, light with the light distribution to which trapezoidal correction is applied can be emitted to illuminate typically a surface inclined with respect to the first axis. The illumination device can also emit light with a light distribution appropriate for other applications, and can emit light with varied light distribution to illuminate a surface such that luminance is varied among regions on the surface. Accordingly, an optical device with which a light distribution appropriate for a surface to be illuminated can be obtained within an illumination device so as to illuminate or project images on roads, signboards, wall surfaces, screens, or the like in an oblique direction, and to illuminate inclined surfaces can be provided, and the illumination device using the optical device can be provided.

While certain embodiments of an optical device and an illumination device using the optical device have been described above, the present invention is not limited the description above, and should be broadly construed on the basis of the claims. The present invention also encompasses variations and modifications that are made on the basis of the description above.

What is claimed is:

1. An optical device comprising:

a plurality of walls including at least a first wall and a second wall, wherein the plurality of walls are concentrically disposed around a first axis so as to be multi-stepped along the first axis, wherein each of the plurality of walls expands outward in a sector shape around the first axis at a predetermined central angle θ and includes an outer circumferential surface, a reflective curved surface at the outer circumferential surface, a first side end portion, and a second side end portion;

a first reflective surface meeting the first side end portions of the walls; and a second reflective surface meeting the second side end portions of the walls, wherein the first reflective surface and the second reflective surface meet each other on the first axis, wherein light incident along the first axis passes through an opening of the first wall at an incident side of the first axis and is reflected at the outer circumferential surface of the second wall at an opposite side of the first axis, opposite to the incident side, wherein an angle at which the first reflective surface and the second reflective surface meet on the first axis at the incident side is different from an angle at which the first reflective surface and the second reflective surface meet on the first axis at the opposite side, and wherein a first central angle of the first wall is different from a second central angle of the second wall.

2. The optical device according to claim 1, wherein the outer circumferential surface of each of the plurality of walls comprises a funnel-shaped reflective curved surface.

3. The optical device according to claim 1, wherein the angle at which the first reflective surface and the second reflective surface meet on the first axis at the opposite side is larger than an angle at which the first reflective surface and the second reflective surface meet on the first axis at the incident side wherein the second central angle is larger than the first central angle.

4. The optical device according to claim 1, wherein each central angle θ satisfies a condition:

$$30 \text{ degrees} \leq \theta \leq 180 \text{ degrees}.$$

5. The optical device according to claim 1, wherein, among the plurality of walls, an outermost wall at the opposite side has an outer circumferential surface without an opening at the incident side.

6. The optical device according to claim 1, wherein at least one of the first reflective surface, the second reflective surface, and the reflective curved surfaces has a mirror surface.

7. An illumination device comprising:

the optical device according to claim 1; and a light source configured to emit light along the first axis.

8. The optical device according to claim 7, wherein each of the reflective curved surfaces comprises a funnel-shaped reflective curved surface.

9. An optical device comprising:

a first reflective structure including multi-stepped sector-shaped reflective curved surfaces configured to divide light incident along a first axis and reflect the divided light in a direction perpendicular to the first axis or inclined with respect to the first axis in different respective predetermined regions in a plane perpendicular to the first axis; and a second reflective structure including a first reflective surface and a second reflective surface that meet at the first axis, wherein an angle at which the first reflective surface and the second reflective surface meet on the first axis at an incident side of the first axis is different from an angle at which the first reflective surface and the second reflective surface meet on the first axis at an opposite side of the first axis, opposite to the incident side, wherein the first reflective structure is disposed between the first reflective surface and the second reflective surface.

10. An illumination device comprising:

the optical device according to claim 9; and a light source configured to emit light along the first axis.

* * * * *